United States Patent [19]

Hall

[11] 4,427,077

[45] Jan. 24, 1984

[54] PORTABLE FASTENING TOOL WITH MANUAL TURN ON AND AUTOMATIC SHUT OFF

[75] Inventor: George D. Hall, Oakmont, Pa.

[73] Assignee: Rockwell International Corporation, Pittsburgh, Pa.

[21] Appl. No.: 88,327

[22] Filed: Oct. 25, 1979

[51] Int. Cl.[3] ..... B25B 23/145

[52] U.S. Cl. ..... 173/12; 81/470

[58] Field of Search ..... 173/12; 81/470

[56] References Cited

U.S. PATENT DOCUMENTS

| | | | |
|---|---|---|---|
| 2,617,971 | 11/1952 | Stack | 173/12 |
| 2,986,052 | 5/1961 | Eckman et al. | 81/470 |
| 3,572,447 | 3/1971 | Pauley et al. | 173/12 |
| 3,834,467 | 9/1974 | Fuchs | 173/12 |
| 3,920,082 | 11/1975 | Dudek | 173/12 |
| 4,161,220 | 7/1979 | Carlin et al. | 173/12 X |
| 4,161,221 | 7/1979 | Carlin et al. | 173/12 X |
| 4,179,786 | 12/1979 | Eshghy | 173/12 X |
| 4,305,471 | 12/1981 | Eshghy | 173/12 |
| 4,316,512 | 2/1982 | Kibblewhite et al. | 173/12 |
| 4,320,806 | 3/1982 | Kohtermann et al. | 173/12 |

*Primary Examiner*—Robert Mackey

[57] ABSTRACT

A portable fastening tool of the type incorporating torque and angle sensors is connected to a data processor which analyzes the torque and angle sensings and generates a shut off signal to terminate tightening. The tool is powered and includes a fluid motor typically energized from a remote source of high pressure air. The data processor is energized by either a battery or an AC source. Termination of tool operation is effected by energizing a solenoid in response to a shut off signal generated by the data processor. In a battery operated embodiment, tool operation is initiated by manual depression of an operating lever while tool termination is effected automatically in response to the shut off signal. This mode of operation reduces the number of required batteries, prolongs battery life and reduces the number and size of electrical components in the tool.

8 Claims, 8 Drawing Figures

PORTABLE FASTENING TOOL WITH MANUAL TURN ON AND AUTOMATIC SHUT OFF

This invention relates to a powered tool for making up threaded fasteners and, in one embodiment, relates to a portable tool.

There has recently been introduced an improved strategy or technique for tightening threaded fasteners which is known as the logarithmic rate method. This technique is disclosed more fully in U.S. Application Ser. No. 912,151, filed June 2, 1978, now U.S. Pat. No. 4,179,786 to which reference is made for a more complete understanding of the background of this invention. Basically, this technique involves the analyzing of torque and angle signals generated during tightening of a threaded fastener to determine a shut off parameter which is peculiar to the fasteners then being tightened. The original hardware design comprises a more-or-less conventional air driven tool having torque and angle sensors and a free standing data processing module. The data processor is energized from a conventional AC power source. The tool includes a connection for high pressure air and a series of electrical connections leading to the data processor to carry torque and angle signals to the data processor, to carry start-stop instructions from the data processor to the tool and to carry power to the tool for energizing the solenoid driven air valve.

In the course of designing a family of tools to carry out the logarithmic rate method, it has become desirable to provide a portable tool in which the data processor is carried by the operator, either in a carrying case or incorporated in the tool itself. In order to make the device portable, by which is meant that it is small enough and light enough to be carried by a normal worker, it is desirable to energize the device with batteries rather than with a conventional AC source. This, of course, frees the use of the tool to any location in a plant having high pressure air for tool operation without regard to the availability of convenient AC power. The availability of high pressure air is, of course, quite common, particularly in manufacturing or assembly plants where the logarithmic rate method has particular application.

One of the difficulties in constructing a practical portable fastening tool lies in the requirement for power to manipulate the air valve controlling operation of the motor. In the devices heretofore made, the tool is started electro-mechanically in the sense that the operator manually closes an electrical switch which acts to deliver power to the air valve solenoid. During operation, the air valve is maintained in its open position by current passing through the air valve solenoid. Valve closing is effected by de-energization of the air valve solenoid which allows the conventional valve return spring to move the valve to its closed position. Since the quantity of power consumed by the valve manipulation is of no substantial concern so long as the tool is connected to a conventional AC power source, it is not surprising that power consumption of the valve operator in the prior art is, relatively, quite large.

Analysis of the valve and valve operation of the prior LRM device reveals four different valve operations which require some type of power expenditure:

(1) valve opening movement—electromechanical, i.e. push button to energize solenoid;

(2) holding valve open—electrical, i.e. solenoid is energized;

(3) valve closing movement—mechanical, i.e. when solenoid is deenergized, valve spring moves valve; and (4) holding valve closed—mechanical, i.e. valve spring holds valve closed.

It is evident that item (3)—"valve closing movement" and item (4)—"holding valve closed" do not consume electrical energy since the operative force is mechanical and is provided by the valve spring. Investigations to date reveal that electrical consumption during valve opening movement constitutes the bulk of electricity used. Analysis reveals that electrical power delivered to the solenoid must be sufficient to overcome the sum of the force applied by the valve spring, the force generated by pressure acting on the moveable valve element, and the frictional force generated between the valve stem and its seals.

As will be more fully pointed out hereinafter, the approach of this invention substantially reduces electrical consumption due to manipulation of the air valve solenoid. Consequently, the size and number of batteries to be carried by the operator may be significantly reduced while prolonging the operative life of the batteries before charging or replacement is required. One of the ancillary advantages of this invention is that several electrical components, specifically resistors and capacitors of substantial size and expense, may be eliminated. It is evident that this reduces the cost of the fastening tool, reduces required maintenance and reduces the weight of the tool to be carried by the operator.

One difficulty with providing for manual initiation of tool operation is that the data processor must know when tool operation commences. In order to provide this invention, a microswitch is incorporated in the tool and is closed during manual movement of the operator manipulated handle. There are two approaches that can be used to inform the data processor that tool operation has started. Preferably, the switch inside the tool is in the power circuit between the battery and data processor. This would, of course, cause an additional improvement in electrical consumption since the data processor would not consume power when the tool is not operating. In the alternative, the switch inside the tool may be in a signaling circuit connected to the data processor.

One problem with all sophisticated tightening strategies, energized by a battery or an A.C. source, that terminate tool tightening in response to the generation of an electrical shut off signal, as opposed to a mechanical shut off approach, is that the tool necessarily does not immediately stop and accordingly "overruns" or continues to further tighten the fastener beyond the desired instant of shut off.

Broadly, there have been two approaches to resolve or minimize this problem. Initially, the approach was to minimize overrun by redesigning the tool and valve shut off mechanism to reduce the inertia of the motor and other rotating parts and to reduce the response time of the valve shut off mechanism. This approach, of course, acts to reduce but not eliminate the tool overrun phenomenon. The approach disclosed in Application Ser. No. 912,151, now U.S. Pat. No. 4,179,786 is to concede that overrun will occur and will vary from joint to joint and compensate therefor by determinations made during tightening of each fastener. It will be seen that this approach substantially eliminates the effect of tool overrun, i.e. imparting additional torque to the fastener beyond that desired to tighten the fastener to its desired final tension value.

In a situation where no compensation for tool overrun is provided, it will be evident that it is highly desirable to minimize overrun. Even if compensation for tool overrun is accomplished, it is desirable to minimize overrun since there is substantially less error in any compensations made if the tool actually being used is a low overrun rather than a high overrun tool.

In summary, this invention comprises a portable fluid driven tool for threadably advancing a fastener. A fluid motor is provided driving a rotatable shaft for rotating the fastener. A power fluid conduit communicates with the motor and includes a normally enclosed valve for opening and closing the conduit for respectively starting and stopping the motor. Means are provided for sensing the torque applied to the fastener and for sensing the angle of rotation of the fastener. A data processor, either incorporated in the tool itself or separately carried by the operator, is connected to the torque and angle sensors for conducting a data processing operation on the torque and angle sensings and generating a shut-off signal in response thereto. A battery or array of batteries is provided, either in the tool or separately carried by the operator, and is connected to the data processor for energizing the same.

In accordance with an important feature of this invention, the value manipulating means includes a hand movable member for moving the valve from its normally closed position to an open position thereby obviating the requirement for large power expenditures each time the tool is turned on. Since tools of the type employing sophisticated tightening procedures are normally utilized in extremely high use situations, for example assembly lines, it is evident that the reduction of power consumption during starting of each tightening cycle can accumulate a large savings in electrical expenditures. An electric motor, usually a solenoid, is energized by the battery or battery array for closing the valve means in response to the shut-off signal generated by the data processor.

The hand movable member of this invention not only acts to initiate the tool cycle by moving the valve to its open position, it is also used to maintain the valve in its open position during tool operation. Consequently, there is no electrical expenditure for battery drain during tool operation.

As will be more fully pointed out hereinafter, the only electrical expenditure required for valve operation is during valve closing movement. It will be seen that if the electrical expenditure during valve closing movement is no greater than during valve opening movement, there will be a net savings of electrical power and a net increase in battery life merely because the valve is not maintained in its open position by an electrically generated force. As will be more evident as this description proceeds, a preferred embodiment of the invention expends substantially less electrical energy during valve closing than does the conventional tool during valve opening. One reason for this improvement is that the air valve solenoid does not have to overcome the substantial force generated on the valve member due to pressure differential thereacross during valve closing movement.

In the prior art stationary LRM tool, electrical consumption per joint is essentially proportional to tool running time. Assuming a typical fastening time of 1.5 seconds with the Rockwell Model 63 size tool, the power consumption is approximately 0.03406 watt-hour/joint. With the present invention, power consumption is proportional to the operator's reaction time or the time from tool shut off until the operator releases the lever. Assuming a typical operator reaction time of 0.5 seconds, the power consumption of this invention is about 0.004445 watt-hour/joint or 13% of that consumed by the prior art device. It will accordingly be seen that the device of this invention substantially reduces electrical consumption thereby allowing the use of fewer batteries while lengthtening the time between battery changes or rechargings.

Another feature of this invention is the provision of a tool energized by either a battery or an A.C. source, exhibiting substantially decreased overrun. By energizing the solenoid in a valve closing direction rather than relying on the conventional spring or differential air pressure across the shut off valve to effect valve closing, the response time from the generation of the shut off signal until the valve is closed is reduced significantly. This reduction in response time can be explained because solenoids normally exhibit a "pull in" time than is shorter than its "drop out" time. In other words, the solenoid is quicker to respond during energization than it is during de-energization. In one model of the device of this invention which has been constructed, the decrease in response time is on the order of about 20%. This has a significant effect on the amount of tool overrun since the amount of overrun is normally directly proportional to the response time between signal generation and valve closing while the amount of overrun due to inertia of the rotating parts of the tool is rather minor. Accordingly, a reduction of 20% in response time will normally result in a reduction of overrun by 20%.

Other objects and a fuller understanding of the invention may be had by referring to the following description and claims taken in conjunction with the acconpanying drawings.

IN THE DRAWINGS

Figure 1:
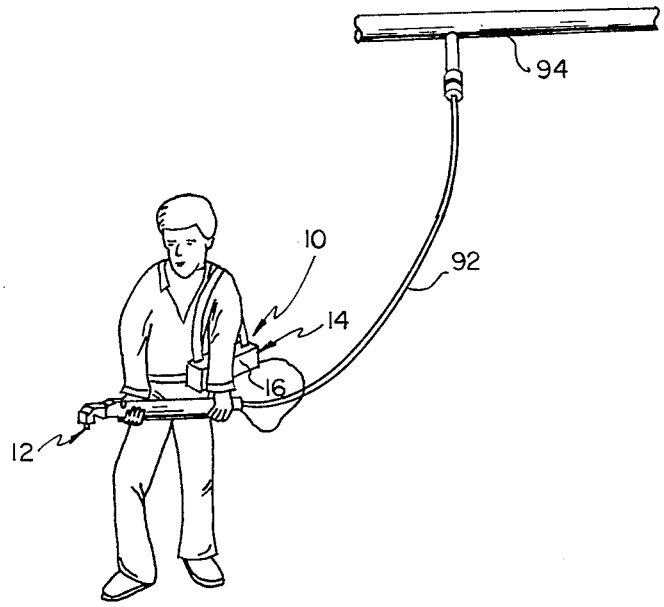
FIG. 1 is a pictorial view of the portable tool of this invention carried by a worker and illustrating the device in a condition ready for use.
Figure 2:
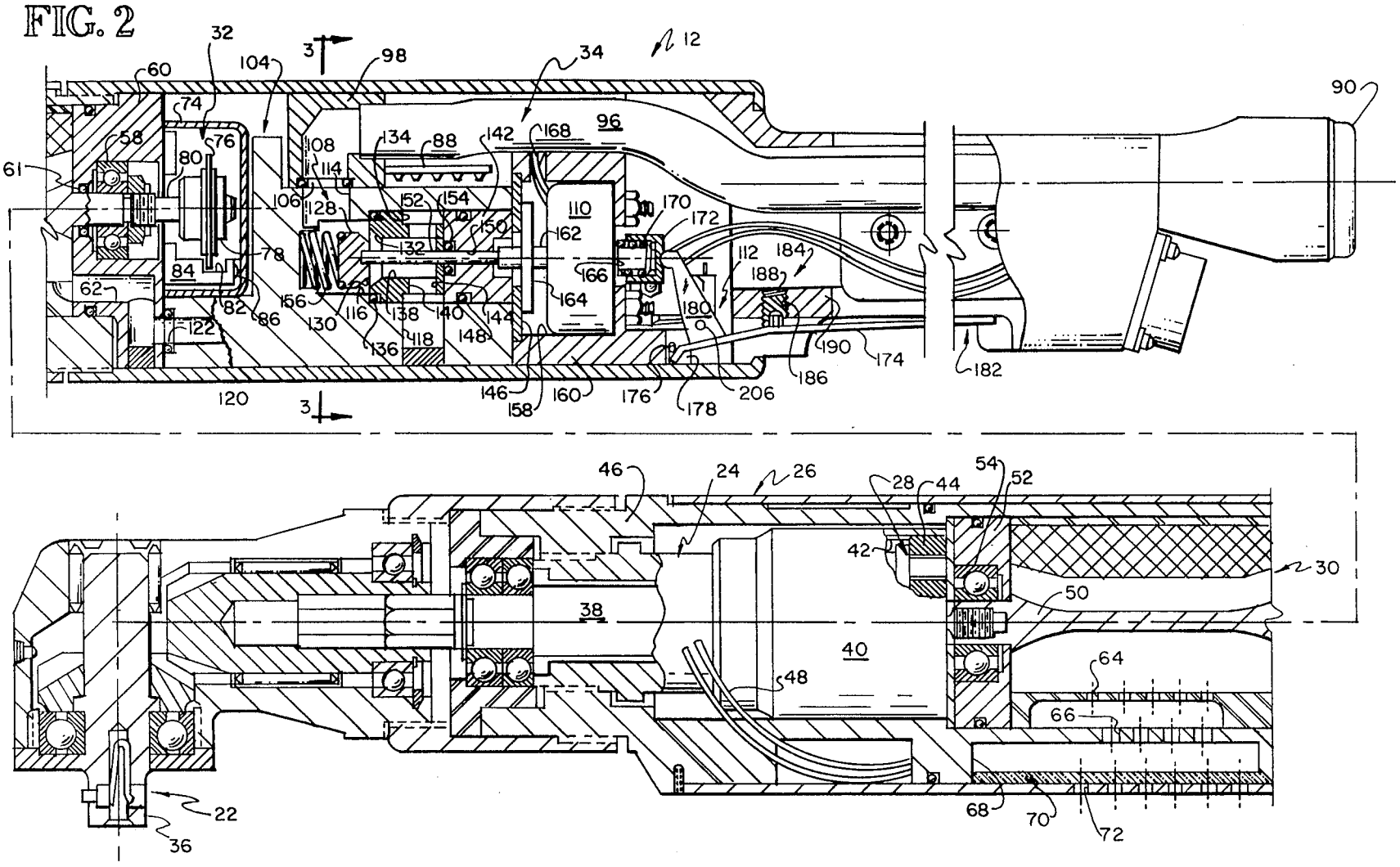
FIG. 2 is a longitudinal cross-sectional view of the tool of FIG. 1.
Figure 5:
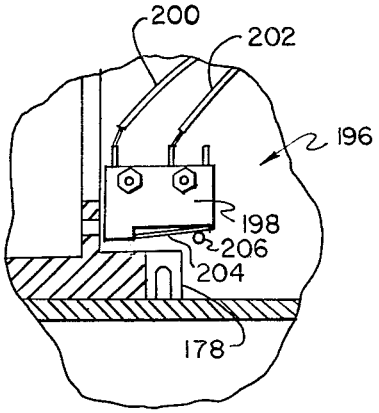
FIG. 5 is a partial broken view of the tool of FIG. 2, certain parts being broken away for clarity of illustration.

Referring to FIGS. 1 and 2, an operator is illustrated as carrying a portable fastening system 10 of this invention which comprises a portable tool 12 and a bodily carried power pack 14. As will be more fully apparent hereafter, the power pack 14 may comprise a belt or shoulder supported receptacle 16 having therein a battery or array of batteries 18 and a data or microprocessor 20.

Referring to FIG. 2, there is illustrated in greater detail the portable fastening or torque applying tool 12 comprising, as major components, a fastener coupling 22, a torque transducer 24, a housing 26 receiving a gear reducer 28 and an air powered motor 30, an angle transducer 32 and an air control unit 34.

The fastener coupling 22 may be of any suitable type and is illustrated as comprising a conventional angle drive having an output shaft or driver 36 for receiving a fitting on the free end thereof such as a socket, screw driver or other torque transmitting connection for releasable driving attachment to a fastener or workpiece.

The output shaft 36 is drivably connected to a shaft 38 which extends through the torque transducer 24 which may be of any convenient type which operates to deliver reliable running torque readings. One suitable type transducer comprises a sleeve 40 having an internal ring gear 42 meshing with the planetary gears 44 of the gear reducer 28. The sleeve 40 is threaded into an annular reaction member 46 to provide a back up for torque applied to the sleeve 40. Suitable strain gauges (not shown) may be affixed to the sleeve 40 in a wheatstone bridge arrangement using technology available from G.S.E., Inc. of Farmington Hills, Mich. A plurality of electrical leads 48 extend from the torque transducer 24 to the micro-processor 20 as suggested in FIG. 4 as more fully explained hereinafter.

The gear reducer 28 may be of any suitable type and is typically of the planetary variety having an input connected to a shaft 50 of the motor 30 and an output connected to the shaft 38. The gear reduction afforded by the reducer 28 is desirably at least 10:1 and is preferably on the order of 20–50:1.

The motor 30 is illustrated as a vane motor having the output drivably connected to the input of the gear reducer 28. The output end of the motor shaft 50 extends through a motor end plate 52 providing suitable bearings 54 for rotatably mounting the output end of the shaft 50. The opposite end of the motor shaft 50 is mounted for rotation by suitable bearings 58 in a motor end plate 60. One or more seals 61 prevent leakage of fluid between the shaft 50 and the motor end plate 60 as will be apparent to those skilled in the art. The end plate 60 provides a plurality of air passages 62 leading from the air control unit 34 to the motor 30. As is customary, air exhausting from the motor 30 passes through a series of openings 64, 66 into an exhaust chamber 68 which is open to the atmosphere through an air permeable member 70 and a plurality of openings 72 in the wall of the housing 26.

The tool 12, as heretofore described, will be recognized by those skilled in the art as basically a Rockwell Model 63 torque applying tool, although, in a production model of the tool 12, the motor 30 has been slightly modified for reasons not here pertinent. For a more complete description of the model 63 tool, reference is made to relevant publications of Rockwell International.

Affixed to the motor end plate 60 is a housing 74 receiving the angle encoder 32. Although the angle encoder 32 may be of any suitable type, it is illustrated as of the optical type available from Litton Systems, Inc., Encoder Division, Model 73. Angle sensors of this type include an encoding disc 76 mounted on a hub 78 affixed to an extension 80 of the motor shaft 50. The disc 76 provides a multiplicity of slots or openings adjacent the periphery thereof which is disposed in a notch 82 in an encoding unit 84 comprising a light source on one side of the disc 76 and a light sensitive element on the other side thereof. Typically, the light source comprises a light emitting diode while the light sensitive element comprises a light sensitive resistor.

An electrical lead (not shown) connects a terminal 86 of the encoding unit 84 to a circuit board 88. The circuit board 88 includes an amplifier for amplifying the output signal of the angle encoder 32.

The housing 26 terminates adjacent one end thereof in an air coupling 90 for connection to an air hose 92 leading to a source of high pressure air 94 as shown best in FIGS. 1 and 2. Inside the housing 26, a conduit 96 provides communication between the coupling 90 and an ell 98 (FIGS. 2 and 3) secured by bolts 100, 102 to a valve housing 104. A suitable seal 106 is disposed between the ell 98 and the valve body 104 for preventing air leakage therebetween.

The air control unit 34 includes the valve housing 104, valve means 108, an electrically driven valve actuator 110 for closing the valve means 108 and a manually operable valve actuator 112 for opening the valve means 108 and for holding it open.

The valve housing 104 includes a generally radial or transverse inlet passage 114 communicating with a longitudinally extending enlarged cavity 116. A transversely extending exhaust passage 118 connects the cavity 116 to a pair of longitudinally extending passages 120 leading to the inlet passages 62 extending through the motor end plate 60. Suitable seals 122 prevent air leakage between the valve housing 104 and motor end plate 60.

The valve means 108 comprises a movable valve element 128 providing a generally frusto-conical valving surface 130 for sealing against a similar seating surface 132 provided by a sleeve 134 sealed against the cavity 116 by a suitable O-ring 136. A longitudinally extending passage 138 communicates with a pair of transverse passages 140 communicating with the transverse passages 118. A sleeve retaining block 142 is disposed in the cavity 116, abuts an apertured end wall 144 of the sleeve 134 and is secured to the valve housing 104 by an annular retaining disc 146 and suitable fasteners (not shown). The sleeve retaining block 142 is sealed against the cavity 116 by a suitable O-ring 148 and provides a longitudinally extending passage 150 for receiving a valve actuating rod 152 connected at one end to the valve element 128 and sealed against the block 142 by a suitable O-ring 154.

The valve means 108 is biased toward a normally closed position by a compression spring 156 abutting against part of the inlet passage 114. The valve means 108 accordingly divides the air passage from the air fitting 90 to the motor 30 into a first section or segment leading toward the fitting 90 and a second section or segment leading toward the motor 30.

The electric valve actuator 110 is disposed in a cavity 158 of a housing 160 and is conveniently a solenoid having a linearly movable output member 162 extending therethrough. The output member 162 is connected to the valve actuating rod 152 and carries a stop 164 for abutting the disc 146 to prevent overtravel of the output member 162 in the opening direction. The output member 162 has affixed thereto a rigid disc or abutment 166 for cooperation with the manual valve actuator 112 as will be explained more fully hereinafter. The solenoid 110 is energized through suitable leads 168 as will also be explained more fully hereinafter.

The manual valve actuator 112 comprises a compression spring 170 surrounding the end of the solenoid output member 162 and abutting the disc 166. A cap 172 surrounds one end of the spring 170. The manual valve actuator 112 also comprises a manually movable member or lever 174 pivotally connected to the housing 26 by a pin 176 extending through a slotted bracket 178 and carries an arm 180 disposed to abut and apply a generally longitudinal force to the cap 172 during movement of the lever 174 in the direction shown by the arrow 182. An adjustable sto 184 is provided to limit the maximum rotation of the lever 174 and thereby limit the maximum force produced by the spring 170. The adjustable stop 184 conveniently comprises an Allen screw 186 received in a threaded opening 188 provided in a strut 190 of the housing 26.

The technique for opening the valve means 108 and maintaining it in an open position should now be apparent. Basically, the operator pulls upwardly on the lever 174 which pivots about the pin 176 to advance the arm 180 into force applying relation to the cap 172. Continued movement of the lever 174 toward the housing 26 compresses the spring 170 against the disc 166. The force applied through the spring 170 is ultimately sufficient to overcome the force acting on the valve element 128 which holds it in sealing relation with the valve seat 132. This force is, of course, the sum of the force produced by the spring 156 in addition to the force generated on the valve element 128 by high pressure air acting thereon.

As the valve element 128 moves away from the valving surface 132, the pressure differential across the valve member 132 becomes negligible so that the force required to hold the valve means 108 open is substantially only the force needed to overcome the compression spring 156.

In order to close the valve means 108 by moving the valve element 128 toward the valve seat 132, the solenoid 110 is actuated. During initial valve closing movement, the valve closing force produced by pressure differential on the valve element 128 is insignificant. Accordingly, the force required from the solenoid 110 to effect valve closing movement initially constitutes the difference between the force transmitted through the spring 170 and the force generated in the compression spring 156. Consequently, electrical consumption during valve closing is quite modest when compared to electrical consumption during valve opening of a comparable electrically opened valve. As the valve element 128 approaches the seating surface 132, the pressure differential across the element 128 becomes significant thereby assisting in valve closing.

Figure 4:
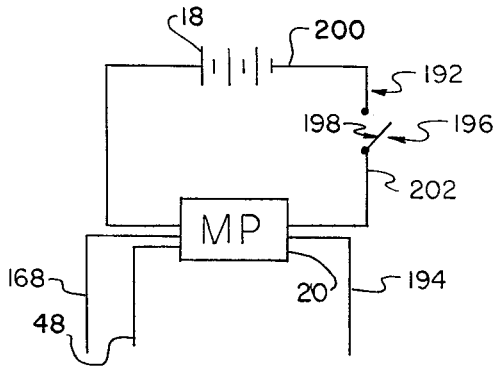
FIGS. 4 and 6 are electrical schematic views of different wiring connections of the system.

Referring to FIG. 4, the micro-processor 20 is illustrated in a power circuit 192 with the battery or array of batteries 18. One or more leads 48 from the torque transducer 24 is connected to the micro-processor 20 to deliver torque data thereto. One or more leads 194 connect the micro-processor 20 to the circuit board 88 for delivering angle data to the microprocessor 20. The leads 168 interconnect the micro-processor 20 and the solenoid 110 for actuating the solenoid in response to the shut-off signal generated in the micro-processor 20, in order to terminate tightening at the desired time.

The micro-processor 20 desirably, but not essentially, conducts a logarithmic rate method analysis of the torque and angle signals appearing on the leads 48, 194 as disclosed more fully in U.S. Application Ser. No. 912,151, filed June 2, 1978 now U.S. Pat. No. 4,179,786, the disclosure of which is incorporated herein by reference. The micro-processor 20 acts to determine a shut-off parameter of a particular fastener while it is being tightened. The logarithmic rate method is typically applicable for tightening seriatim a multiplicity of substantially identical joints. Even with joints that are substantially identical, the shut-off parameter determined by the micro-processor 20 varies from one joint to the next depending primarily on the torque rate of the fastener then being tightened.

In the system 10 of this invention, initiation of the tool 12 is done manually by movement of the operating lever 174. In some fashion or another, the micro-processor 20 must be informed when tool operation commences in order to begin storing and analyzing torque and angle data appearing on the leads 48, 194. To this end, there is provided means 196. In the embodiment of FIG. 4, the means 196 comprises a switch 198 in the power circuit 192 between the battery 18 and the micro-processor 20 in order to energize the micro-processor 20 in response to movement of the lever 174 in a tool actuating direction. A pair of leads 200, 202 comprising part of the circuit 192 and interconnecting the battery 18, the micro-processor 20 and the switch 198. An actuating lever 204 is disposed in the path of movement of a pin 206 carried by the arm 180. In the embodiment of FIG. 4, it will be seen that movement of the actuating lever 174 in the tool starting direction energizes the micro-processor 20 so that the storing of torque and angle data and the analysis thereof commences substantially simultaneously with tool operation.

Figure 6:
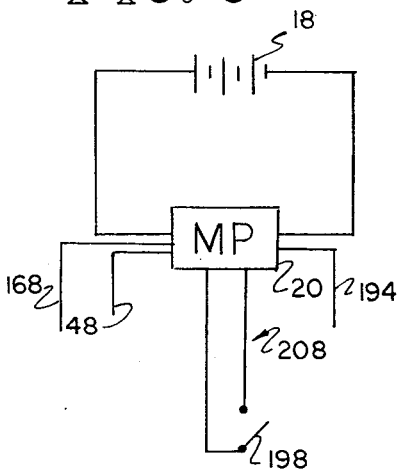

In the embodiment of FIG. 6, the microswitch 198 is positioned in a separate signalling circuit 208 and the internal mechanism of the micro-processor 20 is arranged to detect whether the switch 198 is opened or closed. Any suitable technique to this end may be employed.

Figure 7:
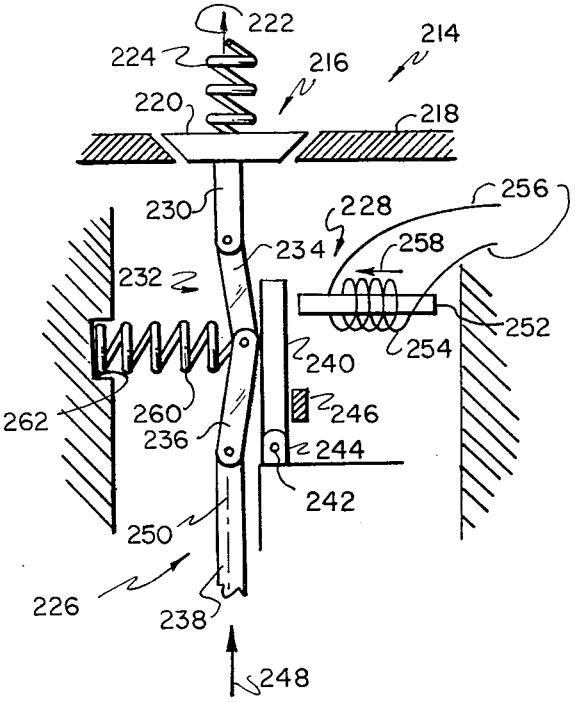
FIGS. 7 and 8 are additional embodiments of the valve manipulation devices of this invention.

Referring to FIG. 7, there is illustrated another embodiment of an air control unit 214 in accordance with the principles of this invention. Valve means 216 comprises a stationary valve seat 218 having a movable valve element 220 mounted for opening movement in the direction indicated by an arrow 222. A compression spring 224 biases the valve element 220 in a closing direction. As in the embodiment of FIGS. 2 and 3, high pressure air as well as the force of the spring 224 maintains the valve element 220 in its closed position.

The air control unit 214 comprises a manual valve actuator 226 for opening the valve means 216 and maintaining it in the open position as well as an electrical actuator 228 for closing the valve. The manual valve actuator 226 comprises an arm 230 rigidly affixed to the valve element 220 and a toggle 232 comprising a pair of pivoted links 234, 236 connecting the arm 230 to a manually movable element 238 operatively connected in any suitable fashion (not shown) to an operator movable element similar to the lever 174 in FIG. 2. An abutment 240 is pivotally connected by a pin 242 to a bracket 244 rigid with the tool housing. A stop 246 engages the abutment 240 and limits clockwise movement thereof. As will be apparent to those skilled in the art, the stop 246 may comprise part of the electrical actuator 228. With the toggle illustrated as shown in FIG. 7, a force applied in the direction of the arrow 248 to the member 238 causes opening movement of the valve element 220 since the toggle 232 is restrained against pivotal movement away from the center line 250 by engagement with the abutment 240.

The electrical valve actuator 228 is conveniently a solenoid comprising a linearly movable output member 252 in conjunction with a winding 254 energized through leads 256. When it is desired to close the valve means 216, the solenoid winding 254 is energized to advance the output member 252 in the direction indicated by the arrow 258 which causes the toggle 232 to move to its opposite over center position thereby breaking the force transmitting connection between the member 238 and the arm 230. Accordingly, the compression spring 224 moves the valve element 220 to the closed position illustrated in FIG. 7.

In order to reset the embodiment 214 for its next cycle of operation, a compression spring 260 is disposed between the toggle 232 and a stationary abutment 262. When the solenoid winding 254 is deenergized, as by the operator releasing the external actuating handle, the compression spring 260 moves the toggle 232, the abutment 240 and the solenoid output 252 across the center line 250 to the configuration illustrated in FIG. 7.

Figure 8:
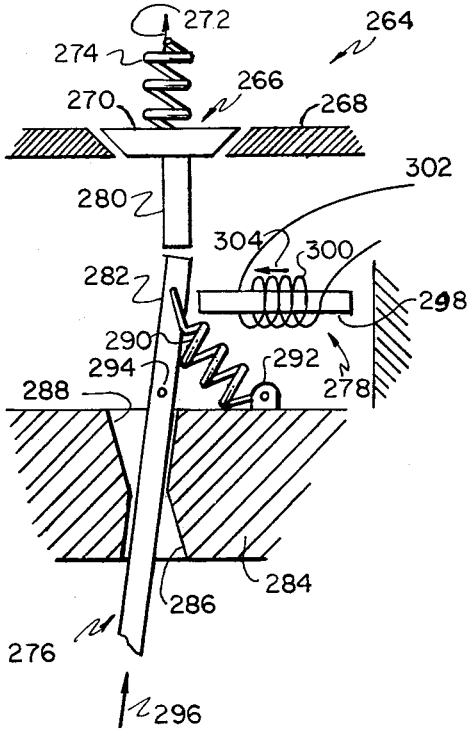

Referring to FIG. 8, there is illustrated another embodiment of an air control unit 264 of this invention. The unit 264 comprises valve means 266 including a valve seat 268 and a valve element 270 mounted for opening movement in the direction indicated by the arrow 272. A compression spring 274 biases the valve element 270 toward the closed position illustrated in FIG. 8. The air control unit 264 also comprises a manual valve actuator 276 for opening the valve means 266 and for holding it in an open position as well as an electric valve actuator 278 for effecting valve closing movement of the element 270.

The manual valve actuator 276 comprises a rod or arm 280 rigid with the valve element 270 and a push rod actuator 282 mounted for movement in a guide 284 having a first frusto conical guide surface 286 merging with the small end of a second frusto conical guide surface 288. A spring 290 connects the push rod actutor 282 to an abutment 292 and acts to pull the push rod 282 away from the arm 280 into the configuration shown in FIG. 8 while a stop 294 on the push rod 282 limits movement of the push rod 282 away from the valve element 270. In order to open the valve means 266, the operator manipulates a control handle similar to the lever 174 to push the actuator 282 in the direction indicated by the arrow 296. Because the ends of the push rod actuator 282 and the rod 280 abut, the valve element 270 is moved in the valve opening direction. So long as the operator holds the operating handle (not shown) in the valve operating position, the valve means 266 remains open.

The electrical valve actuator 278 comprises a linearly movable output member 298 and a winding 300 energized through a pair of leads 302. When the microprocessor 20 determines that the tool should be shut off, the winding 300 is energized to advance the output member 298 in the direction indicated by the arrow 304. During movement of the output member 298, the upper end of the push rod actuator 282 is pushed in a counter clockwise direction as allowed by the guide surfaces 286, 288. Sufficient movement of the output member 298 causes the push rod 282 to move out of engagement with the rod 280 so that the compression spring 274 is able to close the valve 270.

Figure 3:
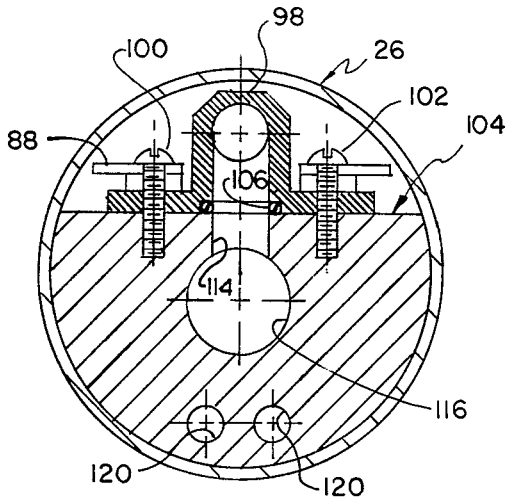
FIG. 3 is a transverse cross-sectional view of the tool of FIG. 2, taken substantially along line 3—3 thereof as viewed in the direction indicated by the arrows.

In order to reset the unit 264 for its next cycle of operation, the solenoid winding 300 is energized and the spring 290 pulls the rod 282 to the position shown in FIG. 3.

It will accordingly be seen that the embodiments of FIGS. 2, 7 and 8 act to minimize electrical consumption by manually opening the air control valve maintaining the air control valve in the open position by manual force and closing the valve in response to actuation of an electrical actuator. It will be evident that electrical consumption per joint tightened is drastically reduced which not only prolongs battery life but which also enable the elimination of conventional electrical components, such as capacitors and resistors, which are typically necessary to deliver high loads from a solenoid actuator.

As will be apparent to those skilled in the art, torque applied to the fastener and the angle of advance of the fastener are specific measurements of what may be more generically called input tightening characteristics. Other input tightening characteristics, such as fastener elongation, stress, motor speed, tightening time, and the like may be employed.

One of the design features of this invention is that the normal mode of terminating tool operation is in response to the generation of the shut off signal while an abnormal or emergency mode of termination is that the operator may merely release the tool operating handle 174. Thus, in the event of an accident, such as the operator's sleeve getting caught in the driver 36, or tool socket (not shown), the operator may terminate tool tightening by merely releasing the handle 174. It will be appreciated that this emergency mode of tool termination is natural to an operator and does not require the intervention of conscious thought, i.e. the operator's first reaction will be to release the handle.

As mentioned previously, one of the advantages of this invention is that the response time between the generation of the shut off signal and the closing of the valve 128 is reduced significantly because the solenoid 110 is energized to drive the valve 128 in the valve closing direction. Consequently, this takes advantage of the normal quicker response time to pull in the solenoid as compared to dropping out of the solenoid. The decrease in response time, which on one version of the invention that has actually been produced is on the order of about 20%, typically results in a like decrease in tool overrun as measured by the elapsed angle between signal generation and stopping of the tool.

Although the invention has been described in its preferred form with a certain degree of particularity, it is understood that the present disclosure is only by way of example and that numerous changes in the details of construction and the combination and arrangement of parts may be resorted to without departing from the spirit and scope of the invention as hereinafter claimed.

I claim:

1. A fastening tool for advancing a threaded fastener, comprising:

a fluid motor driving a rotatable shaft for rotating the fastener;

a power fluid conduit for connection to a source of high pressure fluid and including a valve seat therein separating the conduit into a first section extending toward the source and a second section extending toward the fluid motor;

a valve movable between a closed position engaging the seat toward an open position in the first conduit section for opening and closing the conduit for respectively starting and stopping the motor, the valve being biased in the closed position toward the closed position by high pressure fluid from the fluid source;

means biasing the valve from the open position toward the closed position;

means for sensing input tightening characteristics applied to the fastener by the tool and for generating a signal in response thereto;

means connected to the sensing means for conducting a computation operation on the input tightening characteristic signals and generating a shut off signal in response thereto;

means for connecting the tool to battery means; and means for manipulating the valve comprising a hand movable member mounted for movement from a tool stop position toward a tool running position;

a linkage operated by the member for mechanically moving the valve from its normally closed position toward an open position in opposition to high pressure fluid from the fluid source; and a solenoid, connected to the connecting means and energizable by the battery means, having a linearly movable output member disposed to move the valve from the open position toward the closed position in response to the shut off signal, the output member comprising part of the linkage.

2. The fastening tool of claim 1 wherein the linkage means includes a resilient member for transmitting the valve opening force in one direction through the solenoid output member and enabling movement of the solenoid output member in the opposite direction.

3. The fastening tool of claim 2 wherein the biasing means comprises a valve spring, and the resilient member is arranged to act in opposition to the valve spring when the valve is in the open position and the force generated by the solenoid during valve closing movement is the difference between the forces produced by the valve spring and the resilient member.

4. The tool of claim 2 wherein the linkage comprises a linearly movable rod coaxial with the solenoid output member and the resilient member comprises a compression spring operatively connected to the solenoid output member for transmitting the valve opening force from the hand movable member to the solenoid output member.

5. The tool of claim 4 wherein the rod and the solenoid output member are rigidly connected.

6. The tool of claim 4 wherein the hand movable member comprises a lever, pivotally mounted on the tool, having an arm thereon and means between the arm and the compression spring for transmitting the valve opening force from the lever arm to the compression spring.

7. The fastening tool of claim 6 wherein the last mentioned means comprises a cap having a generally cylindrical side wall receiving the compression spring and an end wall abutting the compression spring on one side thereof and abutting the arm on the other side thereof.

8. A fastening tool for advancing a threaded fastener, comprising a fluid motor driving a rotatable shaft for rotating the fastener;

a power fluid conduit for connection to a source of high pressure fluid and including a valve seat therein separating the conduit into a first section extending toward the source and a second section extending toward the fluid motor;

a valve movable between a closed position engaging the seat toward an open position for opening and closing the conduit for respectively starting and stopping the motor;

means biasing the valve from the open position toward the closed position;

means for sensing input tightening characteristics applied to the fastener by the tool and for generating a signal in response thereto;

means connected to the sensing means for conducting a computation operation on the input tightening characteristic signals and generating a shut off signal in response thereto;

means for connecting the tool to a source of electric power;

and means for manipulating the valve comprising a hand movable member mounted for movement from a tool stop position toward a tool running position;

a linkage operated by the member for mechanically moving the valve from its normally closed position toward an open position; and a solenoid, connected to the connecting means and energizable by the power source, having a linearly movable output member disposed to move the valve from the open position toward the closed position in response to the shut off signal, the output member comprising part of the linkage.

* * * * *